US008414763B2

(12) United States Patent
da Silva Ferreira Alves et al.

(10) Patent No.: US 8,414,763 B2
(45) Date of Patent: Apr. 9, 2013

(54) PROCESS FOR RECOVERING FCC PRODUCT

(75) Inventors: Joao Jorge da Silva Ferreira Alves, Arlington Heights, IL (US); Saadet Ulas Acikgoz, Des Plaines, IL (US); Xin X. Zhu, Long Grove, IL (US); Laura E. Leonard, Western Springs, IL (US)

(73) Assignee: UOP LLC, Des Plaines, IL (US)

( * ) Notice: Subject to any disclaimer, the term of this patent is extended or adjusted under 35 U.S.C. 154(b) by 529 days.

(21) Appl. No.: 12/614,907

(22) Filed: Nov. 9, 2009

(65) Prior Publication Data

US 2011/0108457 A1 May 12, 2011

(51) Int. Cl.

| | |
|---|---|
| ***C10G 11/18*** | (2006.01) |
| ***C10G 7/02*** | (2006.01) |
| ***C10G 5/06*** | (2006.01) |
| ***B01D 3/00*** | (2006.01) |
| ***B01D 3/14*** | (2006.01) |

(52) U.S. Cl. ..... 208/113; 208/46; 208/106; 208/308; 208/341; 208/347; 208/364

(58) Field of Classification Search ..... 208/341, 208/46, 106, 308, 347, 364
See application file for complete search history.

(56) References Cited

U.S. PATENT DOCUMENTS

| | | | | |
|---|---|---|---|---|
| 4,428,202 | A | 1/1984 | Carson | |
| 4,950,387 | A * | 8/1990 | Harandi et al. | 208/49 |
| 7,128,827 | B2 | 10/2006 | Tallman et al. | |
| 7,261,807 | B2 | 8/2007 | Henry et al. | |
| 7,273,542 | B2 * | 9/2007 | Duhon et al. | 208/106 |
| 7,312,370 | B2 | 12/2007 | Pittman et al. | |
| 7,462,276 | B2 | 12/2008 | Wang et al. | |
| 7,491,315 | B2 | 2/2009 | Eng et al. | |
| 2003/0075485 | A1 | 4/2003 | Ghijsen | |
| 2003/0116474 | A1 | 6/2003 | Towler et al. | |
| 2005/0096492 | A1 | 5/2005 | Dath et al. | |
| 2007/0264176 | A1 * | 11/2007 | Stewart et al. | 422/236 |
| 2008/0035527 | A1 | 2/2008 | Eng et al. | |
| 2008/0081937 | A1 | 4/2008 | Schultz et al. | |
| 2008/0223754 | A1 | 9/2008 | Subramanian et al. | |
| 2009/0032438 | A1 | 2/2009 | Zhu et al. | |
| 2009/0112028 | A1 | 4/2009 | Schultz | |
| 2009/0112029 | A1 | 4/2009 | Schultz | |
| 2009/0120780 | A1 | 5/2009 | Wegerer et al. | |

FOREIGN PATENT DOCUMENTS

WO WO 2008/092232 A1 8/2008

OTHER PUBLICATIONS

The Chemistry and Technology of Petroleum, James G. Speight, ed., 1999, Marcel Dekker, Inc., pp. 560-561.*
U.S. Appl. No. 12/614,921, filed Nov. 9, 2009, Alves et al.
Couch, K. et al., Concepts for an overall refinery energy solution through novel integration of FCC flue gas power recovery, NPRA Ann Mtg., Salt Lake City, 2006, p. 28.

(Continued)

*Primary Examiner* — Prem C Singh
*Assistant Examiner* — Derek Mueller
(74) *Attorney, Agent, or Firm* — James C Paschall

(57) ABSTRACT

A process is disclosed for recovering product from catalytically converted product streams. Gaseous unstabilized naphtha from an overhead receiver from a main fractionation column is compressed in a compressor. Liquid unstabilized naphtha from the overhead receiver and liquid naphtha fraction from the compressor are sent to a naphtha splitter column upstream of a primary absorber. Consequently, less naphtha is circulated in the gas recovery system.

20 Claims, 2 Drawing Sheets

OTHER PUBLICATIONS

Linden, David H., Catalyst deposits in fccu power recovery systems can be controlled, Oil & Gas Journal, v 84, n 50, p. 33-38, Dec. 15, 1996.

Zhao et al., Energy optimization of the process for FCC gasoline olefin reduction, Huaxue Goncheng/Chem. Engineering (China), v36 n2, p. 42-45, English Abstract.

Hassan et al., Process integration analysis and retrofit suggestions for an FCC plant, Czech Society of Chemical Engineering, 1998, Praha, Paper N. F7.4 1P.

Al-Riyami et al., Heat integration retrofit analysis of a heat exchanger network of a fluid catalytic cracking plant, Applied Thermal Eng., v 21, n 13-14, p. 1449-1487, 2001.

* cited by examiner

PROCESS FOR RECOVERING FCC PRODUCT

FIELD OF THE INVENTION

This invention generally relates to recovering naphtha product from a fluid catalytic reactor.

DESCRIPTION OF THE RELATED ART

Fluid catalytic cracking (FCC) is a catalytic hydrocarbon conversion process accomplished by contacting heavier hydrocarbons in a fluidized reaction zone with a catalytic particulate material. The reaction in catalytic cracking, as opposed to hydrocracking, is carried out in the absence of substantial added hydrogen or the consumption of hydrogen. As the cracking reaction proceeds substantial amounts of highly carbonaceous material referred to as coke are deposited on the catalyst to provide coked or spent catalyst. Vaporous lighter products are separated from spent catalyst in a reactor vessel. Spent catalyst may be subjected to stripping over an inert gas such as steam to strip entrained hydrocarbonaceous gases from the spent catalyst. A high temperature regeneration with oxygen within a regeneration zone operation burns coke from the spent catalyst which may have been stripped. Various products may be produced from such a process, including a naphtha product and/or a light product such as propylene and/or ethylene.

FCC gaseous products exiting the reactor section typically have a temperature ranging between 482° and 649° C. (900° to 1200° F.). The product stream is introduced into a main fractionation column. Product cuts from the main fractionator column are heat exchanged in a cooler with other streams and pumped back typically into the main column at a tray higher than the pumparound supply tray to cool the contents of the main column. Medium and high pressure steam is typically generated by the heat exchange from the main column pumparounds. Off-gasses from an overhead of the main fractionation column are typically processed in a gas recovery plant to recover valuable lighter products such as fuel gas, liquefied petroleum gas (LPG) and debutanized naphtha. Two types of gas recovery plants include a gas concentration system or a cold box system. A cold box system relies on cryogenic fractionation for product separation. A gas concentration system comprises absorbers and fractionation columns to separate main fractionation column overhead into naphtha and other desired light products. Conventionally, naphtha present in the main column overhead is processed in the gas recovery section and is split into light and heavier fractions downstream of the gas recovery section.

The FCC unit makes more steam than it uses, and the amount of energy exported in the form of steam is an important economic consideration in designing an FCC unit. One way of increasing net steam exported from an FCC unit is by improving heat recovery from the FCC main fractionator column and the gas recovery section. The heat recovered from the main fractionator column is a major source of energy for the gas recovery section and some fraction of the total steam exported from the FCC unit.

Improved apparatuses and processes are desired for recovering valuable products from FCC product gases. Improved apparatuses and processes are desired for recovering valuable products from FCC product gases with lower energy requirements to facilitate greater steam generation.

DEFINITIONS

As used herein, the following terms have the corresponding definitions.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "column" means a distillation column or columns for separating one or more components of different volatilities which may have a reboiler on its bottom and a condenser on its overhead. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the outlet of the column. The bottom temperature is the liquid bottom outlet temperature.

The term "$C_x$−" wherein "x" is an integer means a hydrocarbon stream with hydrocarbons have x and/or less carbon atoms and preferably x and less carbon atoms.

The term "$C_x$+" wherein "x" is an integer means a hydrocarbon stream with hydrocarbons have x and/or more carbon atoms and preferably x and more carbon atoms.

The term "predominant" means a majority, suitably at least 80 wt-% and preferably at least 90 wt-%.

SUMMARY OF THE INVENTION

In a process embodiment, the subject invention involves a fluid catalytic cracking process comprising feeding a hydrocarbon feed to a fluid catalytic cracking reactor. The hydrocarbon feed is contacted with catalyst to provide products and a portion of the products are fed to a main fractionation column. An overhead fraction of the products from the main column is separated in an overhead receiver and a liquid stream from the overhead receiver is split in a naphtha splitter column to provide a light naphtha stream.

In another process embodiment, the subject invention involves a conversion and fractionation process comprising feeding a first hydrocarbon feed to a first reactor to contact hydrocarbon feed with catalyst to provide products. A portion of the products are fed to a naphtha splitter. Lastly, a light naphtha stream from the naphtha splitter is sent to a primary absorber column.

In a further process embodiment, the subject invention involves a catalytic cracking and fractionation process comprising feeding a first hydrocarbon feed to a reactor. The hydrocarbon feed is contacted with catalyst to provide cracked products. A portion of the cracked products is fed to a main fractionation column. An overhead fraction of the cracked products from the main column is separated in an overhead receiver. Lastly, a liquid stream from the overhead receiver is split in a naphtha splitter column to provide a light naphtha stream.

In an apparatus embodiment, the subject invention involves a catalytic apparatus comprising a catalytic reactor and a main fractionation column in communication with the reactor. An overhead receiver communicates with an overhead of the main fractionation column and a naphtha splitter column communicates with a bottom of the overhead receiver.

In another apparatus embodiment, the subject invention involves a conversion and fractionation apparatus comprising a first catalytic reactor and a naphtha splitter column in communication with the first catalytic reactor. A primary absorber column communicates with the naphtha splitter column.

In a further alternative embodiment, the subject invention involves a catalytic cracking apparatus comprising a first reactor and a main fractionation column in communication with said first reactor. An overhead receiver communicates with the main fractionation column and a naphtha splitter column communicates with the overhead receiver.

DETAILED DESCRIPTION OF THE DRAWINGS

Figure 1:
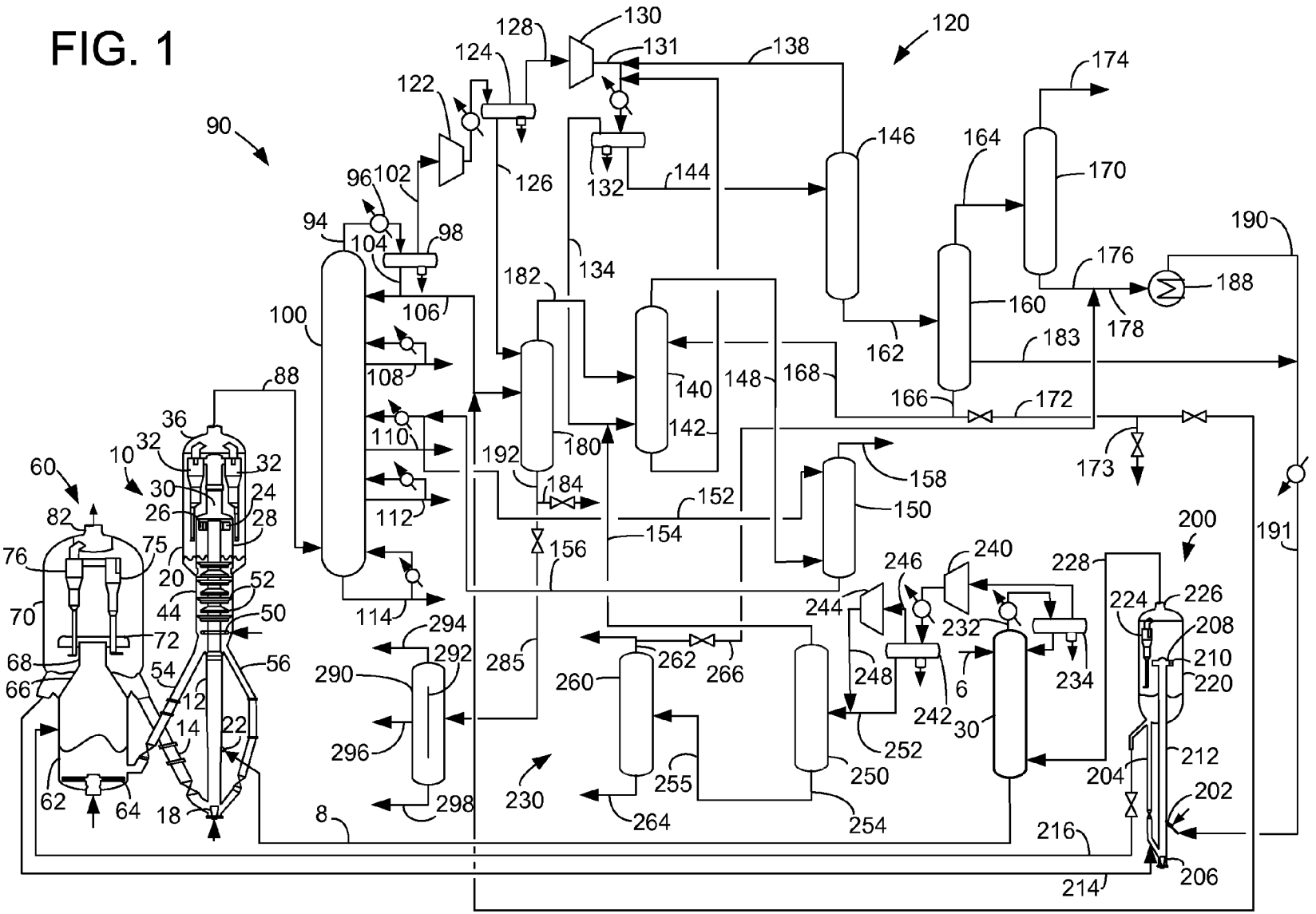
FIG. 1 is a schematic drawing of the present invention.

When multiple naphtha cuts are desired, such as light and heavy naphtha, splitting naphtha after it goes through an assembly of absorbers and fractionation columns in a gas recovery section results in higher reboiler duties and temperatures and unnecessary circulation of heavy material in the columns, heat exchangers and pumps, thus reducing energy efficiency. This invention proposes to split the unstabilized naphtha present in the main column overhead before it is directed to the gas recovery section and particularly the primary absorber instead of splitting naphtha downstream of the gas recovery section. Diverting heavier components of the naphtha naphtha from the reboilers in the stripping column and the debutanizer column, results in lower energy requirement and lower operating temperature for the two reboilers on these two columns.

The invention splits unstabilized light naphtha from the heavier components in a naphtha splitter column. Depending on the boiling point ranges of the naphtha cuts desired, the interstage compressor liquid from the main column fractionator overhead gas compressors may also be directed to the naphtha splitter column. The overhead gas from the naphtha splitter column which consists of light naphtha and lighter components is condensed and sent to the primary absorber. Therefore, only light naphtha is circulated in the gas concentration section. The bottoms product of the naphtha splitter column is rich in heavy naphtha and if desired it can be split into two or more cuts depending on the properties desired in one or more separate naphtha splitters which can be one or more dividing wall columns or conventional fractionation columns.

The present invention is an apparatus and process that may be described with reference to six components shown in FIG. 1: a first catalytic reactor 10, a regenerator vessel 60, a first product fractionation section 90, a gas recovery section 120, an optional second catalytic reactor 200 and an optional second product fractionation section 230. Many configurations of the present invention are possible, but specific embodiments are presented herein by way of example. All other possible embodiments for carrying out the present invention are considered within the scope of the present invention. For example if the first and second reactors 10, 200 are not FCC reactors, the regenerator vessel 60 may be optional.

A conventional FCC feedstock and higher boiling hydrocarbon feedstock are a suitable first feed 8 to the first FCC reactor. The most common of such conventional feedstocks is a "vacuum gas oil" (VGO), which is typically a hydrocarbon material having a boiling range of from 343° to 552° C. (650° to 1025° F.) prepared by vacuum fractionation of atmospheric residue. Such a fraction is generally low in coke precursors and heavy metal contamination which can serve to contaminate catalyst. Heavy hydrocarbon feedstocks to which this invention may be applied include heavy bottoms from crude oil, heavy bitumen crude oil, shale oil, tar sand extract, deasphalted residue, products from coal liquefaction, atmospheric and vacuum reduced crudes. Heavy feedstocks for this invention also include mixtures of the above hydrocarbons and the foregoing list is not comprehensive. Moreover, additional amounts of feed may also be introduced downstream of the initial feed point. The first feed in line 8 may be preheated in wash column 30 which will be further discussed hereafter.

The first reactor 10 which may be a catalytic or an FCC reactor that includes a first reactor riser 12 and a first reactor vessel 20. A regenerator catalyst pipe 14 is in upstream communication with the first reactor riser 12. The regenerator catalyst pipe 14 delivers regenerated catalyst from the regenerator vessel 60 at a rate regulated by a control valve to the reactor riser 12 through a regenerated catalyst inlet. An optional spent catalyst pipe 56 delivers spent catalyst from a disengaging vessel 28 at a rate regulated by a control valve to the reactor riser 12 through a spent catalyst inlet. A fluidization medium such as steam from a distributor 18 urges a stream of regenerated catalyst upwardly through the first reactor riser 12. At least one feed distributor 22 in upstream communication with the first reactor riser 12 injects the first hydrocarbon feed 8, preferably with an inert atomizing gas such as steam, across the flowing stream of catalyst particles to distribute hydrocarbon feed to the first reactor riser 12. Upon contacting the hydrocarbon feed with catalyst in the first reactor riser 12 the heavier hydrocarbon feed cracks to produce lighter gaseous first cracked products while conversion coke and contaminant coke precursors are deposited on the catalyst particles to produce spent catalyst.

The first reactor vessel 20 is in downstream communication with the first reactor riser 12. The resulting mixture of gaseous product hydrocarbons and spent catalyst continues upwardly through the first reactor riser 12 and are received in the first reactor vessel 20 in which the spent catalyst and gaseous product are separated. A pair of disengaging arms 24 may tangentially and horizontally discharge the mixture of gas and catalyst from a top of the first reactor riser 12 through one or more outlet ports 26 (only one is shown) into a disengaging vessel 28 that effects partial separation of gases from the catalyst. A transport conduit 30 carries the hydrocarbon vapors, including stripped hydrocarbons, stripping media and entrained catalyst to one or more cyclones 32 in the first reactor vessel 20 which separates spent catalyst from the hydrocarbon gaseous product stream. The disengaging vessel 28 is partially disposed in the first reactor vessel 20 and can be considered part of the first reactor vessel 20. Gas conduits deliver separated hydrocarbon gaseous streams from the cyclones 32 to a collection plenum 36 in the first reactor vessel 20 for passage to a product line 88 via an outlet nozzle and eventually into the product fractionation section 90 for product recovery. Diplegs discharge catalyst from the cyclones 32 into a lower bed in the first reactor vessel 20. The catalyst with adsorbed or entrained hydrocarbons may eventually pass from the lower bed into an optional stripping section 44 across ports defined in a wall of the disengaging vessel 28. Catalyst separated in the disengaging vessel 28 may pass directly into the optional stripping section 44 via a bed. A fluidizing distributor 50 delivers inert fluidizing gas, typically steam, to the stripping section 44. The stripping section 44 contains baffles 52 or other equipment to promote contacting between a stripping gas and the catalyst. The stripped spent catalyst leaves the stripping section 44 of the disengaging vessel 28 of the first reactor vessel 20 with a lower concentration of entrained or adsorbed hydrocarbons than it had when it entered or if it had not been subjected to stripping. A first portion of the spent catalyst, preferably stripped, leaves the disengaging vessel 28 of the first reactor vessel 20 through a spent catalyst conduit 54 and passes into the regenerator vessel 60 at a rate regulated by a slide valve. The regenerator 60 is in downstream communication with the first reactor 10. A second portion of the spent catalyst is recirculated in recycle conduit 56 back to a base of the riser 12 at a rate regulated by a slide valve to recontact the feed without undergoing regeneration.

The first reactor riser 12 can operate at any suitable temperature, and typically operates at a temperature of about 150° to about 580° C., preferably about 520° to about 580° C. at the riser outlet 24. In one exemplary embodiment, a higher riser temperature may be desired, such as no less than about 565° C. at the riser outlet port 24 and a pressure of from about 69 to about 517 kPa (gauge) (10 to 75 psig) but typically less than about 275 kPa (gauge) (40 psig). The catalyst-to-oil ratio, based on the weight of catalyst and feed hydrocarbons entering the bottom of the riser, may range up to 30:1 but is typically between about 4:1 and about 10:1 and may range between 7:1 and 25:1. Hydrogen is not normally added to the riser. Steam may be passed into the first reactor riser 12 and first reactor vessel 20 equivalent to about 2-35 wt-% of feed. Typically, however, the steam rate may be between about 2 and about 7 wt-% for maximum naphtha production and about 10 to about 15 wt-% for maximum light olefin production. The average residence time of catalyst in the riser may be less than about 5 seconds.

The catalyst in the first reactor 10 can be a single catalyst or a mixture of different catalysts. Usually, the catalyst includes two components or catalysts, namely a first component or catalyst, and a second component or catalyst. Such a catalyst mixture is disclosed in, e.g., U.S. Pat. No. 7,312,370 B2. Generally, the first component may include any of the well-known catalysts that are used in the art of FCC, such as an active amorphous clay-type catalyst and/or a high activity, crystalline molecular sieve. Zeolites may be used as molecular sieves in FCC processes. Preferably, the first component includes a large pore zeolite, such as a Y-type zeolite, an active alumina material, a binder material, including either silica or alumina, and an inert filler such as kaolin.

Typically, the zeolitic molecular sieves appropriate for the first component have a large average pore size. Usually, molecular sieves with a large pore size have pores with openings of greater than about 0.7 nm in effective diameter defined by greater than about 10, and typically about 12, member rings. Pore Size Indices of large pores can be above about 31. Suitable large pore zeolite components may include synthetic zeolites such as X and Y zeolites, mordenite and faujasite. A portion of the first component, such as the zeolite, can have any suitable amount of a rare earth metal or rare earth metal oxide.

The second component may include a medium or smaller pore zeolite catalyst, such as a MFI zeolite, as exemplified by at least one of ZSM-5, ZSM-11, ZSM-12, ZSM-23, ZSM-35, ZSM-38, ZSM-48, and other similar materials. Other suitable medium or smaller pore zeolites include ferrierite, and erionite. Preferably, the second component has the medium or smaller pore zeolite dispersed on a matrix including a binder material such as silica or alumina and an inert filler material such as kaolin. The second component may also include some other active material such as Beta zeolite. These compositions may have a crystalline zeolite content of about 10 to about 50 wt-% or more, and a matrix material content of about 50 to about 90 wt-%. Components containing about 40 wt-% crystalline zeolite material are preferred, and those with greater crystalline zeolite content may be used. Generally, medium and smaller pore zeolites are characterized by having an effective pore opening diameter of less than or equal to about 0.7 nm, rings of about 10 or fewer members, and a Pore Size Index of less than about 31. Preferably, the second catalyst component is an MFI zeolite having a silicon-to-aluminum ratio greater than about 15, preferably greater than about 75. In one exemplary embodiment, the silicon-to-aluminum ratio can be about 15:1 to about 35:1.

The total catalyst mixture in the first reactor 10 may contain about 1 to about 25 wt-% of the second component, including a medium to small pore crystalline zeolite with greater than or equal to about 7 wt-% of the second component being preferred. When the second component contains about 40 wt-% crystalline zeolite with the balance being a binder material, an inert filler, such as kaolin, and optionally an active alumina component, the catalyst mixture may contain about 0.4 to about 10 wt-% of the medium to small pore crystalline zeolite with a preferred content of at least about 2.8 wt-%. The first component may comprise the balance of the catalyst composition. In some preferred embodiments, the relative proportions of the first and second components in the mixture may not substantially vary throughout the first reactor 10. The high concentration of the medium or smaller pore zeolite as the second component of the catalyst mixture can improve selectivity to light olefins. In one exemplary embodiment, the second component can be a ZSM-5 zeolite and the catalyst mixture can include about 0.4 to about 10 wt-% ZSM-5 zeolite excluding any other components, such as binder and/or filler.

The regenerator vessel 60 is in downstream communication with the first reactor vessel 20. In the regenerator vessel 60, coke is combusted from the portion of spent catalyst delivered to the regenerator vessel 60 by contact with an oxygen-containing gas such as air to provide regenerated catalyst. The regenerator vessel 60 may be a combustor type of regenerator as shown in FIG. 1, but other regenerator vessels and other flow conditions may be suitable for the present invention. The spent catalyst conduit 54 feeds spent catalyst to a first or lower chamber 62 defined by an outer wall through a spent catalyst inlet. The spent catalyst from the first reactor vessel 20 usually contains carbon in an amount of from 0.2 to 2 wt-%, which is present in the form of coke. Although coke is primarily composed of carbon, it may contain from 3 to 12 wt-% hydrogen as well as sulfur and other materials. An oxygen-containing combustion gas, typically air, enters the lower chamber 62 of the regenerator vessel 60 through a conduit and is distributed by a distributor 64. As the combustion gas enters the lower chamber 62, it contacts spent catalyst entering from spent catalyst conduit 54 and lifts the catalyst at a superficial velocity of combustion gas in the lower chamber 62 of perhaps at least 1.1 m/s (3.5 ft/s) under fast fluidized flow conditions. In an embodiment, the lower chamber 62 may have a catalyst density of from 48 to 320 $kg/m^3$ (3 to 20 $lb/ft^3$) and a superficial gas velocity of 1.1 to 2.2 m/s (3.5 to 7 ft/s). The oxygen in the combustion gas contacts the spent catalyst and combusts carbonaceous deposits from the catalyst to at least partially regenerate the catalyst and generate flue gas.

The mixture of catalyst and combustion gas in the lower chamber 62 ascend through a frustoconical transition section 66 to the transport, riser section 68 of the lower chamber 62.

The riser section 68 defines a tube which is preferably cylindrical and extends preferably upwardly from the lower chamber 62. The mixture of catalyst and gas travels at a higher superficial gas velocity than in the lower chamber 62. The increased gas velocity is due to the reduced cross-sectional area of the riser section 68 relative to the cross-sectional area of the lower chamber 62 below the transition section 66. Hence, the superficial gas velocity may usually exceed about 2.2 m/s (7 ft/s). The riser section 68 may have a catalyst density of less than about 80 kg/m$^3$ (5 lb/ft$^3$).

The regenerator vessel 60 also may include an upper or second chamber 70. The mixture of catalyst particles and flue gas is discharged from an upper portion of the riser section 68 into the upper chamber 70. Substantially completely regenerated catalyst may exit the top of the transport, riser section 68, but arrangements in which partially regenerated catalyst exits from the lower chamber 62 are also contemplated. Discharge is effected through a disengaging device 72 that separates a majority of the regenerated catalyst from the flue gas. In an embodiment, catalyst and gas flowing up the riser section 68 impact a top elliptical cap of a disengaging device 72 and reverse flow. The catalyst and gas then exit through downwardly directed discharge outlets of the disengaging device 72. The sudden loss of momentum and downward flow reversal cause a majority of the heavier catalyst to fall to the dense catalyst bed and the lighter flue gas and a minor portion of the catalyst still entrained therein to ascend upwardly in the upper chamber 70. Cyclones 75, 76 further separate catalyst from ascending gas and deposits catalyst through diplegs into dense catalyst bed. Flue gas exits the cyclones 75, 76 through a gas conduit and collects in a plenum 82 for passage to an outlet nozzle of regenerator vessel 60 and perhaps into a flue gas or power recovery system (not shown). Catalyst densities in the dense catalyst bed are typically kept within a range of from about 640 to about 960 kg/m$^3$ (40 to 60 lb/ft$^3$). A fluidizing conduit delivers fluidizing gas, typically air, to the dense catalyst bed 74 through a fluidizing distributor. In an embodiment, to accelerate combustion of the coke in the lower chamber 62, hot regenerated catalyst from a dense catalyst bed in the upper chamber 70 may be recirculated into the lower chamber 62 via recycle conduit (not shown).

The regenerator vessel 60 may typically require 14 kg of air per kg of coke removed to obtain complete regeneration. When more catalyst is regenerated, greater amounts of feed may be processed in the first reactor 10. The regenerator vessel 60 typically has a temperature of about 594° to about 704° C. (1100° to 1300° F.) in the lower chamber 62 and about 649° to about 760° C. (1200° to 1400° F.) in the upper chamber 70. The regenerated catalyst pipe 14 is in downstream communication with the regenerator vessel 60. Regenerated catalyst from dense catalyst bed is transported through regenerated catalyst pipe 14 from the regenerator vessel 60 back to the first reactor riser 12 through the control valve where it again contacts the first feed in line 8 as the FCC process continues.

The first cracked products in the line 88 from the first reactor 10, relatively free of catalyst particles and including the stripping fluid, exit the first reactor vessel 20 through the outlet nozzle. The first cracked products stream in the line 88 may be subjected to additional treatment to remove fine catalyst particles or to further prepare the stream prior to fractionation. The line 88 transfers the first cracked products stream to the product fractionation section 90 that in an embodiment may include a main fractionation column 100 and a gas recovery section 120.

The main column 100 is a fractionation column with trays and/or packing positioned along its height for vapor and liquid to contact and reach equilibrium proportions at tray conditions and a series of pump-arounds to cool the contents of the main column. The main fractionation column is in downstream communication with the first reactor 10 and can be operated with an top pressure of about 35 to about 172 kPa (gauge) (5 to 25 psig) and a bottom temperature of about 343° to about 399° C. (650° to 750° F.). In the product recovery section 90, the gaseous FCC product in line 88 is directed to a lower section of an FCC main fractionation column 100. A variety of products are withdrawn from the main column 100. In this case, the main column 100 recovers an overhead stream of light products comprising unstabilized naphtha and lighter gases in an overhead line 94. The overhead stream in overhead line 94 is condensed in a condenser and perhaps cooled in a cooler both represented by 96 before it enters a receiver 98 in downstream communication with the first reactor 10. A line 102 withdraws a light off-gas stream of LPG and dry gas from the receiver 98. An aqueous stream is removed from a boot in the receiver 98. A bottoms liquid stream of light unstabilized naphtha leaves the receiver 98 via a line 104. A first portion of the bottoms liquid stream is directed back to an upper portion of the main column and a second portion in line 106 may be directed to a naphtha splitter column 180 in upstream communication with the gas recovery section 120. Line 102 may be fed to the gas recovery section 120.

Several other fractions may be separated and taken from the main column including an optional heavy naphtha stream in line 108, a light cycle oil (LCO) in line 110, a heavy cycle oil (HCO) stream in line 112, and heavy slurry oil from the bottom in line 114. Portions of any or all of lines 108-114 may be recovered while remaining portions may be cooled and pumped back around to the main column 100 to cool the main column typically at a higher entry location. The light unstabilized naphtha fraction preferably has an initial boiling point (IBP) below in the $C_5$ range; i.e., below about 35° C. (95° F.), and an end point (EP) at a temperature greater than or equal to about 127° C. (260° F.). The boiling points for these fractions are determined using the procedure known as ASTM D86-82. The optional heavy naphtha fraction has an IBP at or above about 127° C. (260° F.) and an EP at a temperature above about 200° C. (392° F.), preferably between about 204° and about 221° C. (400° and 430° F.), particularly at about 216° C. (420° F.). The LCO stream has an IBP below in the $C_5$ range; i.e., below about 35° C. (95° F.) if no heavy naphtha cut is taken or at about the EP temperature of the heavy naphtha if a heavy naphtha cut is taken and an EP in a range of about 260° to about 371° C. (500° to 700° F.) and preferably about 288° C. (550° F.). The HCO stream has an IBP of the EP temperature of the LCO stream and an EP in a range of about 371° to about 427° C. (700° to 800° F.), and preferably about 399° C. (750° F.). The heavy slurry oil stream has an IBP of the EP temperature of the HCO stream and includes everything boiling at a higher temperature.

In the gas recovery section 120, the naphtha splitter column 180 is located upstream of a primary absorber column 140 to improve the efficiency of the gas recovery unit. This embodiment has the advantage of decreasing the molecular weight of the naphtha fed to the gas recovery section 120. Therefore, the lean oil from the primary absorber bottom results in lower reboiling temperatures and also makes it possible to recover heat more efficiently. The gas recovery section 120 is shown to be an absorption based system, but any vapor recovery system may be used including a cold box system.

To obtain sufficient separation of light gas components the gaseous stream in line 102 is compressed in a compressor 122, also known as a wet gas compressor, which is in downstream communication with the main fractionation column overhead receiver 98. Any number of compressor stages may be used, but typically dual stage compression is utilized. In dual stage compression, compressed fluid from compressor 122 is cooled and enters an interstage compressor receiver 124 in downstream communication with the compressor 122. Liquid in line 126 from a bottom of the compressor receiver 124 and the unstabilized naphtha in line 106 from the main fractionation column overhead receiver 98 flow into a naphtha splitter 180 in downstream communication with the compressor receiver 124. By sending the liquid from the interstage receiver 124 to the naphtha splitter column 180, recovery of heavier components that may have remained in the wet gas leaving the main fractionation column in line 102 is enabled as well as maintenance of the same boiling point ranges for the naphtha cuts. In an embodiment, these streams may join and flow into the naphtha splitter 180 together. In an embodiment shown in FIG. 1, line 126 flows into the naphtha splitter 180 at a higher elevation than line 106. The naphtha splitter 180 is also in downstream communication with a bottom of the main fractionation column overhead receiver 98 and the first reactor 10. In an embodiment, the naphtha splitter 180 is in direct downstream communication with the bottom of the overhead receiver 98 of the main fractionation column 100 and/or a bottom of the interstage compressor receiver 124. Gas from the overhead receiver in line 128 from a top of the compressor receiver 124 enters a second compressor 130, also known as a wet gas compressor, in downstream communication with the compressor receiver 124. Compressed effluent from the second compressor 130 in line 131 is joined by streams in lines 138 and 142, and they are cooled and fed to a second compressor receiver 132 in downstream communication with the second compressor 130. Compressed gas from a top of the second compressor receiver 132 travels in line 134 to enter a primary absorber 140 at a lower point than an entry point for the naphtha splitter overhead stream in line 182. The primary absorber 140 is in downstream communication with an overhead of the second compressor receiver 132. A liquid stream from a bottom of the second compressor receiver 132 travels in line 144 to a stripper column 146. The first compression stage compress gaseous fluids to a pressure of about 345 to about 1034 kPa (gauge) (50 to 150 psig) and preferably about 482 to about 690 kPa (gauge) (70 to 100 psig). The second compression stage compresses gaseous fluids to a pressure of about 1241 to about 2068 kPa (gauge) (180 to 300 psig).

The naphtha splitter column 180 may split naphtha into a heavy naphtha bottoms, typically $C_7$+, in line 192 which may be recovered in line 184 with control valve thereon open and control valve on line 285 closed or further processed in line 285 with control valve thereon open and control valve on line 184 closed. An overhead stream from the naphtha splitter column 180 may carry light naphtha in line 182, typically a $C_7$− material, to the primary absorber column 140. Therefore, only light naphtha is circulated in the gas recovery section 120. An overhead stream in line 154 from a depropanizer column 250 may join the compressed gas stream in line 134 to enter the primary absorber column 140 which is in downstream communication with the naphtha splitter column 180. The naphtha splitter column 180 may be operated at a top pressure to keep the overhead in liquid phase, such as about 344 to about 3034 kPa (gauge) (50 to 150 psig) and a temperature of about 135° to about 191° C. (275° to 375° F.).

In a further embodiment, a bottoms stream from the naphtha splitter may be diverted in line 285 through open control valve thereon to a second naphtha splitter column 290. The second naphtha splitter column may have a dividing wall 292 interposed between a feed inlet and a mid-cut product outlet for line 296. The dividing wall has top and bottom ends spaced from respective tops and bottoms of the second naphtha splitter column 290, so fluid can flow over and under the dividing wall 292 from one side to the opposite side. The naphtha splitter may provide an overhead product of middle naphtha in line 294, an aromatics rich naphtha product through the mid-cut product outlet in the line 296 and a heavy naphtha in bottoms product line 298. The second naphtha splitter column 290 may be used in any of the embodiments herein.

The gaseous hydrocarbon streams in lines 134 and 154 fed to the primary absorber column 140 are contacted with naphtha from the naphtha splitter overhead in line 182 to effect a separation between $C_3$+ and $C_2$− hydrocarbons by absorption of the heavier hydrocarbons into the naphtha stream upon counter-current contact. A debutanized naphtha stream in line 168 from the bottom of a debutanizer column 160 is delivered to the primary absorber column 140 at a higher elevation than the naphtha splitter overhead stream in line 182 to effect further separation of $C_3^+$ from $C_2^-$ hydrocarbons. The primary absorber column 140 utilizes no condenser or reboiler but may have one or more pump-arounds to cool the materials in the column. The primary absorber column may be operated at a top pressure of about 1034 to about 2068 kPa (gauge) (150 to 300 psig) and a bottom temperature of about 27° to about 66° C. (80° to 150° F.). A predominantly liquid $C_3^+$ stream with some amount of $C_2^-$ material in solution in line 142 from the bottoms of the primary absorber column is returned to line 131 upstream of the condenser to be cooled and returned to the second compressor receiver 132.

An off-gas stream in line 148 from a top of the primary absorber 140 is directed to a lower end of a secondary or sponge absorber 150. A circulating stream of LCO in line 152 diverted from line 110 absorbs most of the remaining $C_5$+ material and some $C_3$-$C_4$ material in the off-gas stream in line 148 by counter-current contact. LCO from a bottom of the secondary absorber in line 156 richer in $C_3^+$ material than the circulating stream in line 152 is returned in line 156 to the main column 90 via the pump-around for line 110. The secondary absorber column 150 may be operated at a top pressure just below the pressure of the primary absorber column 140 of about 965 to about 2000 kPa (gauge) (140 to 290 psig) and a bottom temperature of about 38° to about 66° C. (100° to 150° F.). The overhead of the secondary absorber 150 comprising dry gas of predominantly $C_2$− hydrocarbons with hydrogen sulfide, amines and hydrogen is removed in line 158 and may be subjected to further separation to recover ethylene and hydrogen.

Liquid from a bottom of the second compressor receiver 132 in line 144 is sent to the stripper column 146. Most of the $C_2$− material is stripped from the $C_3$-$C_7$ material and removed in an overhead of the stripper column 146 and returned to line 131 via overhead line 138 without first undergoing condensation. The overhead gas in line 138 from the stripper column comprising $C_2$− material, LPG and some light naphtha is returned to line 131 without first undergoing condensation. The condenser on line 131 will partially condense the overhead stream from line 138 and the gas compressor discharge in line 131 and with the bottoms stream 142 from the primary absorber column 140 will together undergo vapor-liquid separation in second compressor receiver 132. The stripper column 146 is in downstream communication with the first reactor 10, a bottom of the second compressor receiver 132, a bottom of the primary absorber 140 and an overhead of the naphtha splitter 180. The stripper may be run at a pressure above the compressor 130 discharge at about 1379 to about 2206 kPa (gauge) (200 to 320 psig) and a temperature of about 38° to about 149° C. (100° to 300° F.). The bottoms product of the stripper column 146 in line 162 is rich in light naphtha.

FIG. 1 shows that the liquid bottoms stream from the stripper column 146 may be sent to a first debutanizer column 160 via line 162. The debutanizer column 160 is in downstream communication with the first reactor 10, a bottom of the second compressor receiver 132, the bottom of the primary absorber 140 and an overhead of the naphtha splitter 180. The debutanizer column 160 may fractionate a portion of first cracked products from the first reactor 10 to provide a $C_4$– overhead stream and $C_5^+$ bottoms stream. A portion of the debutanizer bottoms in line 166 may be split between line 168 carrying debutanized naphtha to the primary absorber column 140 to assist in the absorption of $C_3^+$ materials and line 172, with both control valves thereon open, which may recycle debutanized naphtha to the naphtha splitter 180, optionally in combination with line 106. If desired, another portion of the bottoms product debutanized naphtha can be taken in line 173, with control valve thereon open and the downstream control valve on line 172 closed, as a product or further split into two or more cuts depending on the properties desired in one or more separate naphtha splitters (not shown) which can be one dividing wall column or one or more conventional fractionation columns. Typically, 25 to 50 wt-% of the debutanized naphtha is recycled back to the primary absorber 140 in line 168 to control the recovery of light hydrocarbons. The debutanizer column may be operated at a top pressure of about 1034 to about 1724 kPa (gauge) (150 to 250 psig) and a bottom temperature of about 149° to about 204° C. (300° to 400° F.). The pressure should be maintained as low as possible to maintain reboiler temperature as low as possible while still allowing complete condensation with typical cooling utilities without the need for refrigeration. The overhead stream in line 164 from the debutanizer comprises $C_3$-$C_4$ olefinic product which can be sent to an LPG splitter column 170 which is in downstream communication with an overhead of the debutanizer column 160.

In the LPG splitter column 170, $C_3$ materials may be forwarded from the overhead in a line 174 to a $C_3$ splitter to recover propylene product. $C_4$ materials from the bottom in line 176 may be recovered for blending in a gasoline pool as product or further processed. The LPG splitter 170 may be operated with a top pressure of about 69 to about 207 kPa (gauge) (10 to 30 psig) and a bottom temperature of about 38° to about 121° C. (100° to 250° F.).

In an embodiment, $C_4$ material in line 176 may be delivered as a second hydrocarbon feed to a second catalytic reactor 200 which is in downstream communication with an overhead of the main fractionation column 100, a bottom of the primary absorber 140 and a bottom of the LPG splitter 170. In an embodiment, the $C_4$ stream in line 176 may be vaporized in evaporator 188 from which vaporized naphtha exits in line 190 and is preferably superheated before it is fed to the second catalytic reactor 200. The second catalytic reactor 200 is in downstream communication with the vaporizer 188. In an embodiment, a light naphtha stream may be withdrawn from a side of the debutanizer 160 as a side cut in line 183. The side cut may be taken from a vapor side draw to avoid having to vaporize a liquid stream in an evaporator. The side cut naphtha in line 183 may be mixed with the vaporized $C_4$ stream in line 190 to provide second hydrocarbon feed in line 191, so the second reactor 200 may be in downstream communication with the first debutanizer column 160 via the vapor side draw. A heat exchanger on line 191 may superheat the vaporized second hydrocarbon feed. The vapor side draw for line 183 should be in the lower half of the first debutanizer column 160 and below the feed entry for line 162.

The second catalytic reactor 200 may be a second FCC reactor. Although the second reactor 200 is depicted as a second FCC reactor, it should be understood that any suitable catalytic reactor can be utilized, such as a fixed bed or a fluidized bed reactor. The second hydrocarbon feed may be fed to the second reactor 200 in recycle feed line 190 via feed distributor 202. The second feed can at least partially be comprised of $C_{10}$– hydrocarbons, preferably comprising $C_4$ to $C_7$ olefins. The second hydrocarbon feed predominantly comprises hydrocarbons with 10 or fewer carbon atoms and preferably between 4 and 7 carbon atoms. The second hydrocarbon feed is preferably a portion of the first cracked products produced in the first reactor 10, fractionated in the main column 100 of the product recovery section 90 and provided to the second reactor 200. In an embodiment, the second reactor is in downstream communication with the product fractionation section 90 and/or the first reactor 10 which is in upstream communication with the product fractionation section 90.

The second reactor 200 may include a second reactor riser 212. The second hydrocarbon feed is contacted with catalyst delivered to the second reactor 200 by a catalyst return pipe 204 in upstream communication with the second reactor riser 212 to produce cracked upgraded products. The catalyst may be fluidized by inert gas such as steam from distributor 206. Generally, the second reactor 200 may operate under conditions to convert the light naphtha feed to smaller hydrocarbon products. $C_4$-$C_7$ olefins crack into one or more light olefins, such as ethylene and/or propylene. A second reactor vessel 220 is in downstream communication with the second reactor riser 212 for receiving upgraded products and catalyst from the second reactor riser. The mixture of gaseous, upgraded product hydrocarbons and catalyst continues upwardly through the second reactor riser 212 and is received in the second reactor vessel 220 in which the catalyst and gaseous hydrocarbon, upgraded products are separated. A pair of disengaging arms 208 may tangentially and horizontally discharge the mixture of gas and catalyst from a top of the second reactor riser 212 through one or more outlet ports 210 (only one is shown) into the second reactor vessel 220 that effects partial separation of gases from the catalyst. The catalyst can drop to a dense catalyst bed within the second reactor vessel 220. Cyclones 224 in the second reactor vessel 220 may further separate catalyst from second cracked products. Afterwards, the second cracked hydrocarbon products can be removed from the second reactor 200 through an outlet 226 in downstream communication with the second reactor riser 212 through a second cracked products line 228. Separated catalyst may be recycled via a recycle catalyst pipe 204 from the second reactor vessel 220 regulated by a control valve back to the second reactor riser 212 to be contacted with the second hydrocarbon feed.

In some embodiments, the second reactor 200 can contain a mixture of the first and second catalyst components as described above for the first reactor. In one preferred embodiment, the second reactor 200 can contain less than about 20 wt-%, preferably less than about 5 wt-% of the first component and at least 20 wt-% of the second component. In another preferred embodiment, the second reactor 200 can contain only the second component, preferably a ZSM-5 zeolite, as the catalyst.

The second reactor 200 is in downstream communication with the regenerator vessel 60 and receives regenerated catalyst therefrom in line 214. In an embodiment, the first catalytic reactor 10 and the second catalytic reactor 200 both share the same regenerator vessel 60. The same catalyst composition may be used in both reactors 10, 200. However, if a higher proportion of small to medium pore zeolite is desired in the second reactor 200, replacement catalyst added to the second reactor 200 may comprise a high proportion of the second catalyst component. Because the second catalyst component does not lose activity as quickly as the first catalyst component, less of the catalyst inventory need be forwarded to the catalyst regenerator 60 but more catalyst inventory may be recycled to the riser 212 in return conduit 204 without regeneration to maintain the high level of the second catalyst component in the second reactor 200. Line 216 carries spent catalyst from the second reactor vessel 220 with a control valve for restricting the flow rate of catalyst from the second reactor 200 to the regenerator vessel 60. The catalyst regenerator is in downstream communication with the second reactor 200 via line 216. A means for segregating catalyst compositions from respective reactors in the regenerator 60 may also be implemented.

The second reactor riser 212 can operate in any suitable condition, such as a temperature of about 425° to about 705° C., preferably a temperature of about 550° to about 600° C., and a pressure of about 40 to about 700 kPa (gauge), preferably a pressure of about 40 to about 400 kPa (gauge), and optimally a pressure of about 200 to about 250 kPa (gauge). Typically, the residence time of the second reactor riser 212 can be less than about 5 seconds and preferably is between about 2 and about 3 seconds. Exemplary risers and operating conditions are disclosed in, e.g., US 2008/0035527 A1 and U.S. Pat. No. 7,261,807 B2.

The second products from the second reactor 200 in line 228 are directed to a second product recovery section 230. Another aspect of the apparatus and process is heat recovery from the second products in line 228 from the second reactor 200 in the wash column 30. The wash column 30 is in downstream communication with said second reactor 200 and in upstream communication with the first reactor 10. FIG. 1 shows, in an embodiment, a first hydrocarbon feed line 6 carrying a first hydrocarbon feed for the first reactor 10 to be contacted in a wash column 30 with the second product in line 228 to preheat the first hydrocarbon feed 6 and cool the second products in line 228. The wash column 30 is in downstream communication with the first hydrocarbon feed line 6. The second product stream in line 228 is fed to a lower section of the wash column 30 and is contacted with the first hydrocarbon feed from line 6 fed to the upper section of the wash column 30 in a preferably countercurrent arrangement. The wash column 30 may include pump-arounds (not shown) to increase the heat recovery but no reboiler. The second product stream includes relatively little LCO, HCO and slurry oil which get absorbed along with catalyst fines in the second products into the first hydrocarbon feed in line 8 exiting the bottom of the wash column 30 in line 8. The wash column 30 transfers heat from the second products stream to the first hydrocarbon feed stream which serves to cool the second product stream and heat the first hydrocarbon feed stream, conserving the heat. By this contact, the first hydrocarbon feed 6 may be consequently heated to about 140° to about 320° C. and picks up catalyst that may be present in the second product from the second reactor 200. The heated hydrocarbon feed exits the wash column 30 in line 8. The first reactor 10 is in downstream communication with the wash column via line 8. The picked up catalyst can further catalyze reaction in the first reactor 10. The wash column is operated at a top pressure of about 35 to about 138 kPa (gauge) (5 to 20 psig) and a bottom temperature of about 288° to about 343° C. (550° to 650° F.). The cooled second product exits the wash column in line 232.

The cooled second products in overhead line 232, are partially condensed and enter into a wash column receiver 234. A liquid potion of the second products are returned to an upper section of the wash column 30 and a vapor portion of the second products is directed to a third compressor 240 which is in downstream communication with the wash column 30 and the second reactor 200. The third compressor 240 may be only a single stage or followed by one compressor 244 or more. In the case of two stages, as shown in FIG. 1, interstage compressed effluent is cooled and fed to an interstage receiver 242. Liquid from the receiver 242 in line 252 is fed to a depropanizer column 250 while a gaseous phase in line 246 is introduced to the fourth compressor 244. The compressed gaseous second product stream in line 248 from the fourth compressor 244 at a pressure of about 1379 to about 2413 kPa (gauge) (200 to 350 psig) is fed to the depropanizer column 250 via line 252.

The depropanizer column 250 is in downstream communication with the second reactor 200. In the depropanizer column 250, fractionation of the compressed second product stream occurs to provide a $C_3$− overhead stream and a $C_4$+ bottoms stream. To avoid unnecessarily duplicating equipment the depropanizer column overhead stream carrying a light portion of the second products from the second reactor is processed in the gas recovery section 120. An overhead line 154 carries an overhead stream of $C_3$− materials to join line 134 and enter a lower section of the primary absorber column 140 in the gas recovery section 120. The heavier $C_3$ hydrocarbons from the $C_3$− overhead stream are absorbed into the naphtha stream in the primary absorber column 140. This allows common recovery of propylene and dry gas and eliminates the need for duplicate absorption systems or alternate light olefin separation schemes. The depropanizer column 250 operates with a top pressure of about 1379 to about 2413 kPa (gauge) (200 to 350 psig) and a bottom temperature of about 121° to about 177° C. (250° to 350° F.). A depropanized bottom stream in line 254 exits the bottom of the depropanizer column 250 and enters a second debutanizer column 260 through line 254.

The second debutanizer column 260 is in downstream communication with the second reactor 200. In the second debutanizer column 260, fractionation of a depropanized portion of the compressed second product stream occurs to provide a $C_4$− overhead stream and a $C_5$+ light naphtha bottoms stream. An overhead line 262 carries an overhead stream of predominantly $C_4$ hydrocarbons to undergo further processing or recovery. The second debutanizer column 260 operates with a top pressure of about 276 to about 690 kPa (gauge) (40 to 100 psig) and a bottom temperature of about 93° to about 149° C. (200° to 300° F.). A debutanized bottoms light naphtha stream in line 264 exits the bottom of the second debutanizer column 260 which may be further processed or sent to the gasoline pool.

The apparatus and process has the flexibility of providing recycle material from the second product recovery section 130 with no impact on the gas recovery section 120. If a small recycle flow rate is required to achieve the target propylene yield then, vaporized $C_4$ hydrocarbons from the overhead line 262 of a second debutanizer column 260 may be diverted in line 266 through an open control valve thereon and carried to line 176. FIG. 1 shows the case in which the diverted $C_4$ hydrocarbons are not sufficiently vaporized, so they join line 176 carrying $C_4$ hydrocarbons in the LPG splitter bottoms stream to feed line 178. Both streams in line 266 and 176 carry $C_4$ hydrocarbons, so are suitable to be vaporized together in evaporator heat exchanger 188. Vaporized $C_4$ hydrocarbons travel in line 190 and may be superheated in a heat exchanger before being fed as a portion of second hydrocarbon feed to the second reactor 200.

Figure 2:
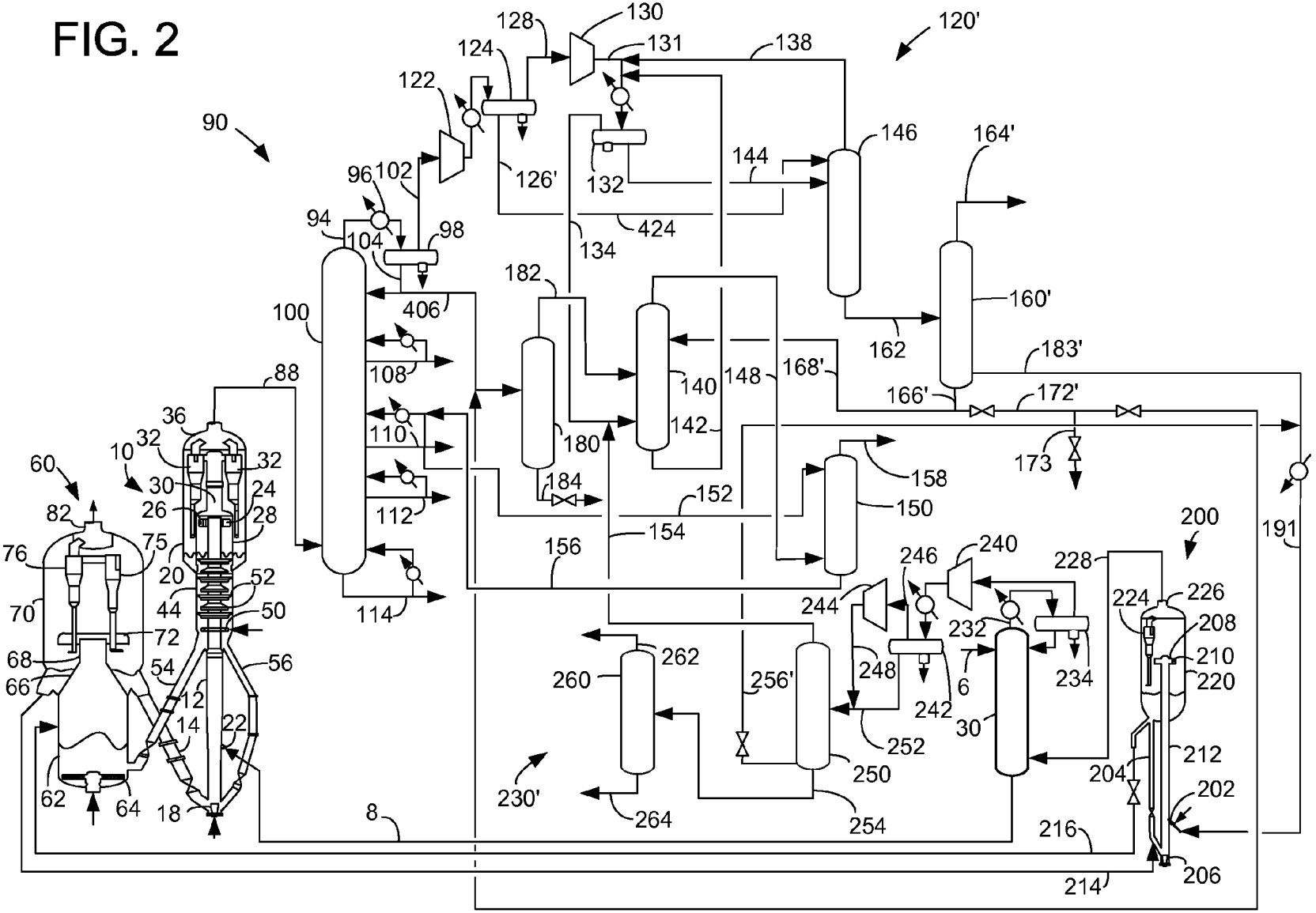
FIG. 2 is a schematic drawing of an alternative embodiment of the present invention.

In another embodiment of the invention shown in FIG. 2, the naphtha splitter remains upstream of the gas recovery section as in FIG. 1, but the debutanizer column is replaced with a depropanizer column and the LPG splitter column is eliminated resulting in a more energy efficient and lower capital cost design albeit with reduced flexibility. Elements in FIG. 2 that are different from FIG. 1 are indicated by a reference numeral with a prime symbol (’). All other items in FIG. 2 are the same as in FIG. 1.

The gas recovery section 120' is different in FIG. 2 than in the embodiment of FIG. 1. Depending on the boiling point ranges of the naphtha cuts desired, the interstage compressor liquid in line 126' may alternatively be directed to the stripper column 146. Under this alternative, interstage compressor liquid in line 126' flows into the stripper column 146 at an entry location at a higher elevation than for line 144. Otherwise, all or a part of the interstage compressor liquid in line 126' flows to the naphtha splitter 180, as previously described for FIG. 1.

A liquid bottoms stream from the stripper column 146 is sent to a first depropanizer column 160' via line 162. The first depropanizer column 160' is in downstream communication with the first reactor 10 and fractionates a portion of first cracked products from the first reactor 10 to provide a $C_3$− overhead stream and $C_4$+ bottoms stream. The overhead stream in line 164' from the first depropanizer column comprises $C_3$ olefinic product which can be sent to a propane/propylene splitter (not shown) which may be in communication with an overhead of the depropanizer column 160'. The bottoms stream in line 166' may be split between line 168' for delivering depropanized naphtha to the primary absorber 140 to assist in the absorption of $C_3^+$ materials and line 172' for recycle to the naphtha splitter column 180 or product recovery in line 173.

In an embodiment, a light naphtha stream may be withdrawn from a side of the first depropanizer column 160' as a side cut in line 183' taken below the feed entry point for line 162. The side cut may predominantly comprise $C_4$-$C_7$ hydrocarbons. The side cut may be from a vapor side draw to avoid having to vaporize a liquid stream in an evaporator. The side cut naphtha in line 183' may provide all of the second hydrocarbon feed in line 191 or may be mixed with vaporous depropanized side draw material in recycle line 256' to provide the second hydrocarbon feed in line 191. The second reactor 200 may be in downstream communication with the first depropanizer column 160' via the vapor side draw feeding line 183'. A heat exchanger on line 191 may superheat the vaporized second hydrocarbon feed.

Operation of the second reactor 200, in downstream communication with the depropanizer column 160', and the second product recovery section 230' is generally as is described with respect to FIG. 1. One exception is the vapor side draw that is taken from a second depropanizer column 250 in line 256' for recycle to the second reactor 200. In this embodiment, the depropanizer column 250 is a second depropanizer column 250 and the debutanizer column 260 is the first debutanizer column 260. All other aspects of this embodiment may be the same as described for FIG. 1.

EXAMPLE

An FCC gas recovery section was simulated as a base case with a naphtha splitter column downstream of the gas recovery section. The naphtha splitter column only provided cuts of light naphtha and heavy naphtha. An additional FCC gas recovery section was simulated for the invention shown in FIG. 1 but which takes all light naphtha from line 172 in line 173 and all heavy naphtha from line 192 in line 184. The simulations obtained the same product flow rates and very similar fractionation boiling point cuts from both the base case and the inventive case.

For the comparison, both simulations were run to insure the same recovery of $C_3$ and $C_4$ hydrocarbons in both cases. The flow rate of light naphtha recycle from the bottoms of the debutanizer column in line 168 to the primary absorber column had to be increased in the Inventive Case because less unstabilized naphtha is sent to the primary absorber column from the main column receiver bottom and the wet gas compressor receiver overhead relative to the Base Case. Also, the flow rate of LCO recycled in line 152 to the secondary absorber from the main column and back had to be increased to obtain the same $C_4$ recovery in the secondary absorber.

The heating duties for the stripper columns, the debutanizer columns and the naphtha splitter columns in the gas recovery sections for the Base Case and the Inventive Case are shown in Table I. Table I shows a 28% reduction in total heating duty for the reboilers.

TABLE I

| | BASE CASE (Gcal/hr) | INVENTIVE CASE (Gcal/hr) |
|---|---|---|
| Debutanizer Reboiler | 46.58 | 41.9 |
| Naphtha Splitter Reboiler | 21.86 | 15.73 |
| Stripper Reboiler | 37.77 | 23.65 |
| Debutanizer Feed Preheat | 6.912 | 3.440 |
| Stripper Feed Preheat | 7.58 | 5.914 |
| Naphtha Splitter Feed Preheat | — | 3.472 |
| Total Heating Duty | 120.7 | 94.11 |

For the Inventive Case, the naphtha splitter column reboiler had a higher outlet temperature by 36° C. due to operating at higher pressure to keep the overhead product in the liquid phase. However, this was more than made up for by the lower outlet temperatures of the debutanizer column and the stripper column reboilers which were significantly decreased by 40 and 19° C., respectively. The temperature decreases in the Inventive Case were due to only light naphtha being circulated in the gas concentration section. Consequently, less high grade heat is needed to reboil these columns.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated. Additionally, control valves expressed as either open or closed can also be partially opened to allow flow to both alternative lines.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A fluid catalytic cracking process comprising:

feeding a first hydrocarbon feed to a first fluid catalytic cracking reactor;

contacting said first hydrocarbon feed with catalyst to provide first products;

feeding a portion of said first products to a main fractionation column;

separating an overhead fraction of said first products from said main fractionation column in an overhead receiver to provide a bottoms liquid stream;

sending a portion of said bottoms liquid stream directly from said overhead receiver to a naphtha splitter; and splitting a liquid stream from said overhead receiver in a naphtha splitter column to provide a light naphtha stream.

2. The fluid catalytic cracking process of claim 1 further comprising feeding said light naphtha stream to a primary absorber column.

3. The fluid catalytic cracking process of claim 1 further comprising:

feeding a portion of said light naphtha stream as a second hydrocarbon feed to a second reactor; and contacting said second hydrocarbon feed with catalyst to provide second products.

4. The fluid catalytic cracking process of claim 2 further comprising feeding a portion of a liquid fraction from said primary absorber column to a debutanizer column.

5. The fluid catalytic cracking process of claim 4 further comprising feeding a light naphtha fraction from said debutanizer column as feed to a second reactor.

6. The fluid catalytic cracking process of claim 5 wherein said light naphtha fraction is a vapor side draw from the debutanizer column.

7. The fluid catalytic cracking process of claim 4 further comprising feeding an overhead fraction from said debutanizer column to an LPG splitter column and feeding a bottoms stream from said LPG splitter column to a second reactor.

8. The fluid catalytic cracking process of claim 1 further comprising compressing a gaseous stream from said overhead receiver, separating a liquid fraction from a compressed gaseous fraction and feeding said liquid fraction to said naphtha splitter column.

9. The fluid catalytic cracking process of claim 1 further comprising compressing a gaseous stream from said overhead receiver, separating a liquid fraction from a compressed gaseous fraction and feeding said compressed gaseous fraction to a primary absorber column and at least a portion of said liquid fraction to a column.

10. The fluid catalytic cracking process of claim 9 further comprising feeding at least a portion of a light naphtha stream from said naphtha splitter to said primary absorber column.

11. The fluid catalytic cracking process of claim 1 further comprising feeding a bottoms stream from said naphtha splitter column to a heavy naphtha splitter column to provide two or more heavy naphtha cuts.

12. A conversion and fractionation process comprising:

feeding a hydrocarbon feed to a reactor;

contacting said hydrocarbon feed with catalyst to provide products;

feeding a portion of said products comprising unstabilized naphtha from an overhead receiver of a main fractionation column directly to a naphtha splitter; and sending a light naphtha stream from said naphtha splitter to a primary absorber column.

13. The conversion and fractionation process of claim 12 further comprising fractionating said products in said main fractionation column; separating an overhead fraction of said first products from said main column in said overhead receiver; and sending a liquid stream comprising the unstabilized naphtha from said overhead receiver to said naphtha splitter.

14. The conversion and fractionation process of claim 13 further comprising compressing a gaseous stream from said overhead receiver, separating a liquid fraction from a compressed gaseous fraction and feeding said liquid fraction to said naphtha splitter.

15. The conversion and fractionation process of claim 13 further comprising compressing a gaseous stream from said overhead receiver, separating a liquid fraction from a compressed gaseous fraction and feeding said gaseous fraction to a primary absorber.

16. The conversion and fractionation process of claim 15 further comprising feeding at least a portion of said liquid fraction from said overhead receiver to a debutanizer, feeding a light naphtha stream from said debutanizer as a second hydrocarbon feed to a second reactor and contacting said second hydrocarbon feed with catalyst to provide second products.

17. The conversion and fractionation process of claim 15 further comprising feeding at least a portion of said liquid fraction to a depropanizer column, feeding a light naphtha stream from said depropanizer column as a second hydrocarbon feed to a second reactor and contacting said second hydrocarbon feed with catalyst to provide second products.

18. The conversion and fractionation process of claim 12 further comprising feeding a bottoms stream from said naphtha splitter to a heavy naphtha splitter column to provide two or more heavy naphtha cuts.

19. A catalytic cracking and fractionation process comprising:

feeding a hydrocarbon feed to a reactor;

contacting said hydrocarbon feed with catalyst to provide cracked products;

feeding a portion of said cracked products to a main fractionation column;

separating an overhead fraction of said cracked products from said main fractionation column in an overhead receiver to provide a liquid stream comprising unstabilized naphtha; and splitting said liquid stream comprising unstabilized naphtha from said overhead receiver in a naphtha splitter column to provide a light naphtha stream.

20. The catalytic cracking and fractionation process of claim 19 further comprising compressing a gaseous stream from said overhead receiver, separating a liquid fraction from a compressed gaseous fraction, feeding said liquid fraction to said naphtha splitter column and further compressing said compressed gaseous fraction.

* * * * *